US005117810A

United States Patent [19]

Threatt

[11] Patent Number: 5,117,810

[45] Date of Patent: Jun. 2, 1992

[54] APPARATUS FOR SEALING A FOAM INSULATED WATER HEATER

[75] Inventor: Gary S. Threatt, Kershaw, S.C.

[73] Assignee: AOS Holding Company, Wilmington, Del.

[21] Appl. No.: 787,289

[22] Filed: Nov. 4, 1991

[51] Int. Cl.[5] ..... F24H 1/00; B29C 65/00

[52] U.S. Cl. ..... 126/361; 126/373; 220/444; 220/448; 122/494

[58] Field of Search ..... 126/361, 373, 344, 362, 126/363; 220/444, 902, 445, 446, 448, 447, 431, 432; 264/45.2, 46.7, 46.9, 46.5; 122/494

[56] References Cited

U.S. PATENT DOCUMENTS 3,253,731 5/1966 Fink et al. ..... 220/444
4,477,399 10/1984 Tilton ..... 264/45.2
4,527,543 7/1985 Denton ..... 126/361
4,744,488 5/1988 Nelson ..... 220/444
4,790,290 12/1988 Chevalier et al. ..... 126/361
4,901,676 2/1990 Nelson ..... 220/444

*Primary Examiner*—James C. Yeung
*Attorney, Agent, or Firm*—James Earl Lowe, Jr.; David R. Price

[57] ABSTRACT

A water heater comprising a tank which is adapted to contain water and which has an outer surface, a spud mounted on the outer surface of the tank, a jacket surrounding the tank, having an inner surface spaced from the outer surface of the tank, and having therein an opening aligned with the spud, a member connected to the spud, insulating material between the tank and the jacket, and an annular seal for sealing the opening from the insulating material, the seal surrounding the member, having a radially inner portion captured between the member and the spud, and having a radially outer portion engaging the inner surface of the jacket.

20 Claims, 1 Drawing Sheet

APPARATUS FOR SEALING A FOAM INSULATED WATER HEATER

BACKGROUND OF THE INVENTION

The invention relates to foam insulated water heaters, and more particularly to apparatus for sealing foam insulated water heaters.

A conventional foam insulated water heater includes a water tank having therein at least one opening. An internally threaded spud is welded or otherwise secured to the outer surface of the tank in alignment with the opening. An outer jacket surrounds the tank and has therein an opening aligned with the spud. A fitting extends through the opening in the outer jacket and is threaded on to the spud. The fitting is in turn adapted to be connected to a pipe or another component that communicates with the interior of the tank via the spud.

As is known in the art, foam is injected into the space between the outer jacket and the tank in order to insulate the tank. During injection of the foam it is desirable to prevent the foam from flowing out of the opening in the outer jacket. U.S. Pat. No. 4,790,290, which is assigned to the assignee hereof, discloses an apparatus for sealing the opening in the jacket. This apparatus is connected to the spud in place of the fitting during the foaming process. The apparatus is removed and replaced by the fitting after foaming is completed.

SUMMARY OF THE INVENTION

The invention provides an apparatus for sealing the opening in the outer jacket with the fitting already connected to the spud. More particularly, the invention provides an annular seal extending between the jacket and the spud so as to substantially seal the opening in the jacket from the space between the tank and the jacket.

The seal is made of a flexible plastic and includes an accordion-like or bellows-like radially inner portion surrounding the fitting. When the fitting is threaded into the spud, the inner portion of the seal is compressed between the spud and a shoulder on the fitting. The inner portion of the seal consequently sealingly engages both the spud and the fitting. The seal also includes a cup-shaped radially outer portion opening toward the jacket. The outer portion of the seal is integral with the inner portion and has a feathered annular periphery engaging the inner surface of the jacket. The entire seal is compressed between the spud and the jacket so that the periphery of the seal sealingly engages the inner surface of the jacket.

The seal is used as follows in assembling a water heater. First, the tank, the jacket, the spud and the seal are arranged as described above. Then the fitting is threaded into the spud so as to compress the inner portion of the seal as described above. Then foam is injected into the space between the tank and the jacket. Because of its sealing engagement with each of the spud, the fitting and the jacket, the seal substantially prevents foam from flowing out of the opening in the jacket.

Other features and advantages of the invention will become apparent to those skilled in the art upon review of the following detailed description, claims and drawings.

Figure 1:
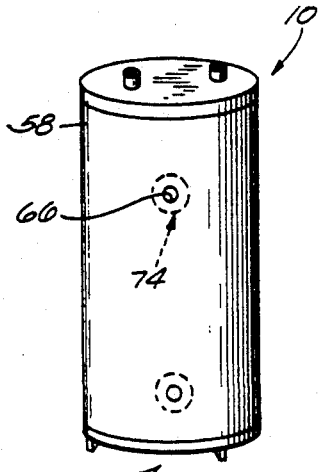
FIG. 1 is a perspective view of a water heater embodying the invention and including a spud and a seal.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 3:
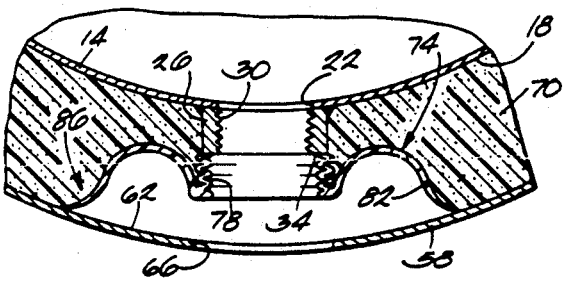
FIG. 3 is a view taken along line 3—3 in FIG. 2.

A water heater 10 embodying the invention is illustrated in the drawings. The water heater 10 comprises (see FIG. 3) a tank 14 adapted to contain water. Any suitable means known in the art can be employed to heat the water within the tank 14. The tank 14 has a generally cylindrical outer surface 18 and has therein an opening 22 communicating with the interior of the tank 14.

The water heater 10 also comprises a conventional spud 26 welded or otherwise mounted on the outer surface 18 of the tank 14. The spud 26 has therethrough a threaded bore 30 communicating with the opening 22 in the tank 14. The spud 26 also has an outer end 34.

Figure 4:
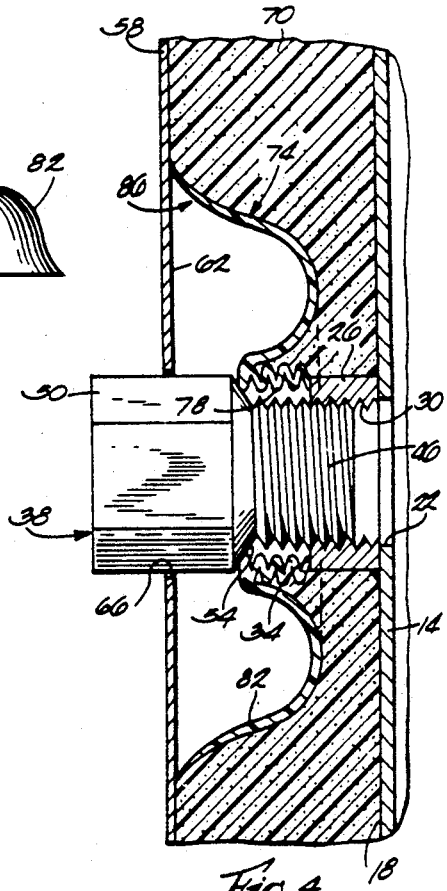
FIG. 4 is a view taken along line 4—4 in FIG. 2 with a fitting threaded into the spud.
Figure 2:
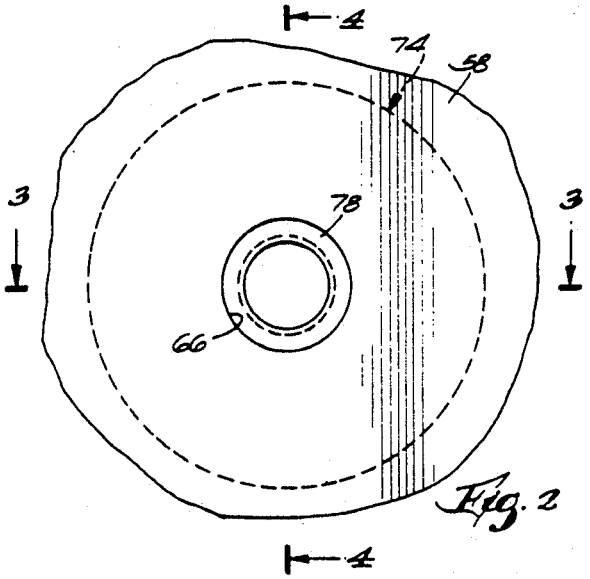
FIG. 2 is an enlarged, partial, elevational view of the water heater.

The water heater 10 further comprises (see FIG. 4) a fitting or member 38 connected to the spud 26. The fitting 38 has therethrough a passageway (not shown) communicating with the spud bore 30 and thereby with the tank opening 22. In the illustrated construction, the fitting 38 includes a reduced-diameter portion 46 which is externally threaded and which threads into the spud bore 30. The fitting 38 also includes an enlarged-diameter portion 50 which is internally threaded and which is adapted to receive an externally threaded element (not shown) such as a pipe. The reduced-diameter portion 46 and the enlarged-diameter portion 50 of the fitting 38 define therebetween a shoulder 54 which, in the illustrated construction, is tapered or frustoconical. In alternative embodiments of the invention the shoulder 54 could extend parallel to the end 34 of the spud 26.

The water heater 10 further comprises an outer jacket 58 surrounding the tank 14. The jacket 58 has an inner surface 62 spaced from the outer surface 18 of the tank 14, and the jacket 58 has therein an opening 66 aligned with the spud 26 such that the fitting 38 extends through the opening 66. The water heater 10 further comprises foam insulating material 70 between the tank 14 and the jacket 58. The insulating material 70 is preferably injected into the space between the tank 14 and the jacket 58 as is known in the art.

Figure 5:
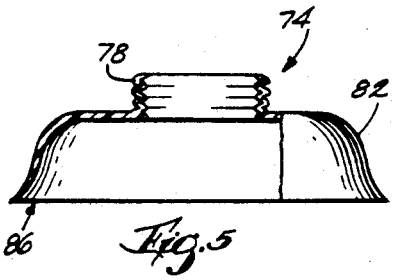
FIG. 5 is a partially sectional view of the seal in its uncompressed state.

In order to prevent foam from flowing out of the opening 66 in the jacket 58 during the foam injection process, means are provided for sealing the opening 66 from the foam insulating material 70. This means includes an annular seal 74 surrounding the fitting 38. The seal 74 is preferably made of a flexible plastic and is shown in FIG. 5 in its uncompressed state. The seal 74 has an accordion-like or bellows-like radially inner portion 78 which surrounds the fitting 38 and which is compressed between the fitting shoulder 54 and the end 34 of the spud 26. Such compression of the inner portion 78 of the seal 74 creates a seal between the inner portion 78 and the fitting 38 and between the inner portion 78 and the spud 26. The seal 74 also has a radially outer portion 82 integral with the inner portion 78. The outer portion 82 is cup-shaped and opens outwardly or toward the inner surface 62 of the jacket 58. The outer portion 82 has a feathered or radially outwardly tapered annular periphery 86 engaging the inner surface 62 of the jacket 58. The entire seal 74 is compressed between the jacket 58 and the spud 26 so as to create a seal between the seal periphery 86 and the inner surface 62 of the jacket 58.

The water heater 10 is assembled as follows. First, the jacket 58 is placed over the tank 14 with the jacket opening 66 aligned with the spud 26 and with the seal 74 located between the spud 26 and the inner surface 62 of the jacket 58. Such location of the seal 74 compresses the seal 74 between the inner surface 62 of the jacket 58 and the end 34 of the spud 26. This creates the seal between the seal periphery 86 and the inner surface 62 of the jacket 58. Next, the fitting 38 is threaded into the spud 26 so that the inner portion 78 of the seal 74 is compressed between the fitting shoulder 54 and the end 34 of the spud 26. This creates the seal between the seal 74 and the fitting 38 and between the seal 74 and the spud 26. Finally, the foam insulating material 70 is injected into the space between the tank 14 and the jacket 58. The seal 74 substantially prevents the foam from flowing out of the opening 66. Once the foam has hardened the fitting 38 can be removed from the spud 26 if necessary.

Figure 6:
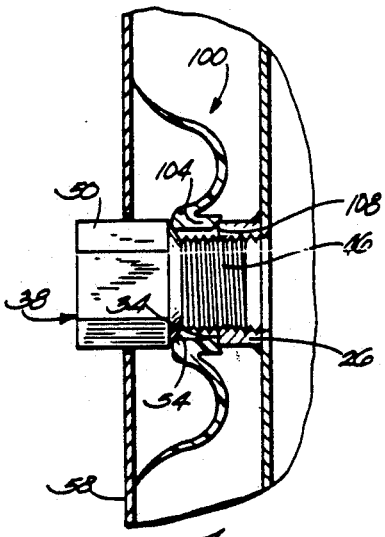
FIG. 6 is a view similar to FIG. 4 of an alternative embodiment of the invention.

An alternative seal 100 is illustrated in FIG. 6. Instead of an accordion-like inner portion, the seal 100 has a resilient, tubular inner portion 104 including a tapered or frustoconical inner surface 108 that is forced or wedged over the end 34 of the spud 26 so as to create a seal between the inner portion 104 and the spud 26. Otherwise, the seal 100 is substantially identical to the seal 74 of the preferred embodiment, and common elements have been given the same reference numerals.

Various features of the invention are set forth in the following claims.

I claim:

1. A water heater comprising a tank which is adapted to contain water and which has an outer surface, a spud mounted on said outer surface of said tank, a jacket surrounding-said tank, having an inner surface spaced from said outer surface of said tank, and having therein an opening aligned with said spud, a member connected to insulating material between said tank and said jacket, and means for sealing said opening from said insulating material, said means including an annular seal surrounding said member, having a radially inner portion captured between said member and said spud, and having a radially outer portion engaging said inner surface of said jacket.

2. A water heater as set forth in claim 1 wherein said spud and said member are threadedly connected.

3. A water heater as set forth in claim 1 wherein said inner portion of said seal is compressed between said member and said spud.

4. A water heater as set forth in claim 3 wherein said member also includes a shoulder, and wherein said inner portion of said seal is compressed between said shoulder and said spud.

5. A water heater as set forth in claim 3 wherein said inner portion of said seal has an accordion-like construction.

6. A water heater as set forth in claim 1 wherein said inner portion has a tapered inner surface forced over said spud.

7. A water heater as set forth in claim 1 wherein said outer portion of said seal is cup-shaped and opens toward said jacket.

8. A water heater as set forth in claim 7 wherein said outer portion of said seal has an annular periphery engaging said inner surface of said jacket.

9. A water heater as set forth in claim 8 wherein said periphery is feathered.

10. A water heater as set forth in claim 1 wherein said seal is compressed between said spud and said inner surface of said jacket.

11. A water heater comprising a tank which is adapted to contain water and which has an outer surface, a spud mounted on said outer surface of said tank, a jacket surrounding said tank, having an inner surface spaced from said outer surface of said tank, and having therein an opening aligned with said spud, insulating material between said tank and said jacket, and means for sealing said opening from said insulating material, said means including an annular seal having a radially inner portion engaging said spud, and having a radially outer portion which is cup-shaped, which opens toward said jacket, and which has an annular periphery engaging said inner surface of said jacket.

12. A water heater as set forth in claim 11 and further comprising a member threadedly connected to said spud.

13. A water heater as set forth in claim 12 wherein said inner portion of said seal is compressed between said member and said spud.

14. A water heater as set forth in claim 13 wherein said member also includes a shoulder, and wherein said inner portion of said seal is compressed between said shoulder and said spud.

15. A water heater as set forth in claim 13 wherein said inner portion of said seal has an accordion-like construction.

16. A water heater as set forth in claim 11 wherein said inner portion has a tapered inner surface forced over said spud.

17. A water heater as set forth in claim 11 wherein said periphery is feathered.

18. A water heater as set forth in claim 11 wherein said seal is compressed between said spud and said inner surface of said jacket.

19. A water heater comprising a tank which is adapted to contain water and which has an outer surface, a spud mounted on said outer surface of said tank, a jacket surrounding said tank, having an inner surface spaced from said outer surface of said tank, and having therein an opening aligned with said spud, a member which includes a shoulder and which is threadedly connected to said spud, insulating material between said tank and said jacket, and means for sealing said opening from said insulating material, said means including an annular seal which surrounds said member, which is compressed between said spud and said inner surface of said jacket, which has an accordion-like radially inner portion compressed between said shoulder and said spud, and which has a radially outer portion that is cup-shaped, that opens toward said jacket, and that has an annular periphery engaging said inner surface of said jacket.

20. A water heater as set forth in claim 19 wherein said periphery is feathered.

* * * * *